US005257902A

United States Patent [19]

Atarashi et al.

[11] Patent Number: 5,257,902

[45] Date of Patent: Nov. 2, 1993

[54] BLOWER WITH IMPROVED IMPELLER VANES

[75] Inventors: Masahiro Atarashi, Kusatsu; Kiyoshi Sano, Otsu; Shotaro Ito, Shiga, all of Japan

[73] Assignee: Matsushita Electric Industrial Co., Ltd., Kadoma, Japan

[21] Appl. No.: 836,741

[22] Filed: Feb. 19, 1992

[30] Foreign Application Priority Data

Feb. 27, 1991 [JP] Japan ..... 3-031138

[51] Int. Cl.[5] ..... F04D 29/66

[52] U.S. Cl. ..... 415/119; 416/229 R; 416/231 R

[58] Field of Search ..... 416/181, 229 R, 231 R, 416/231 A; 415/119

[56] References Cited

U.S. PATENT DOCUMENTS

| | | | |
|---|---|---|---|
| D. 265,681 | 8/1982 | Kan | 416/229 R |
| 2,161,182 | 6/1939 | Massey | 416/231 R |
| 2,509,376 | 5/1950 | Trask | 416/231 R |
| 3,749,520 | 7/1973 | Bandukwalla . | |
| 3,779,338 | 12/1973 | Hayden et al. . | |
| 3,992,491 | 11/1976 | Ihrig et al. | 416/231 R |
| 4,746,271 | 5/1988 | Wright | 416/241 A |
| 4,869,644 | 9/1989 | Takigawa | 415/119 |

FOREIGN PATENT DOCUMENTS

| | | | |
|---|---|---|---|
| 112269 | 10/1964 | Czechoslovakia | 415/119 |
| 1628355 | 10/1970 | Fed. Rep. of Germany . | |
| 3-237298 | 10/1991 | Japan | 416/236 R |
| 26654 | of 1910 | United Kingdom | 416/231 R |

*Primary Examiner*—Edward K. Look
*Assistant Examiner*—James A. Larson
*Attorney, Agent, or Firm*—Cushman, Darby & Cushman

[57] ABSTRACT

A blower includes a plurality of rotatable impeller vanes operable to impel air. The impeller vanes create an air pressure differential thereacross when rotated, and each of the impeller vanes has a porous central portion made of sintered resin material. The porous central portion has a plurality of pores therein which permit a portion of air to pass through the porous central portion from a relatively high air pressure side to a relatively low air pressure side of the impeller vanes. Each of the impeller vanes also has a non-porous portion surrounding the porous central portion. The non-porous portion is made of a solid resin material which prevents air from passing therethrough.

12 Claims, 7 Drawing Sheets

BLOWER WITH IMPROVED IMPELLER VANES

FIELD OF THE INVENTION AND THE RELATED ART

1. Field of the Invention

The present invention relates to a blower used in an air conditioner and the like, and a method of manufacturing an impeller for the blower.

2. Description of the Related Art

As a noise reduction techniques, a method of using a porous material for the material of vanes of an impeller is known in the art. An example in the case of a multi-blade fan (Japanese Unexamined Published Patent Application No. Sho 63-32196) is shown in FIG. 1. In FIG. 1, impeller 1 of a blower has vanes 4 disposed between a fixed upper frame 2 and a lower disc 3. The vanes 4 are attached therebetween by bonding, fitting or welding. The vanes 4 are totally constituted by a porous material, such as porous metals, porous synthetic resins and porous ceramics.

Next, a section of the vanes 4 in FIG. 1 is shown in FIG. 2. As shown in FIG. 2, in the section 4*a* of the vane 4, numerous holes which are communicating from the lower face to the upper face of the vanes 4 are formed. Thereby, a part of air flow A1 along the lower face of the vanes 4 is led to the upper face of the vanes 4 via the numerous holes as shown by air flows A2. The air flow along a surface boundary layer of the vanes 4 having a relatively low velocity is accelerated by the air flows A2. The air flows A2 are effective in distributing an air velocity distribution B1 along the upper face of the vanes 4 uniformly. Thereby, separation of air flow from the surface of the vanes 4 is prevented, and noises due to turbulences of the air flow A3 are reduced.

In the above-mentioned conventional configuration, however, the porous material, through which the upper and lower faces of the vanes 4 are in communication, is difficult to form as compared with usual non-porous materials and is insufficient in strength. When the vanes 4 of the blower are constituted with such porous materials, the dimensional accuracy of face shapes of the vanes 4, in particular, the accuracy of the end shapes which rotate through the air is inferior and a predictable performance can not be obtained because the material is constituted with granules. In addition to difficulty in forming, the vanes must be connected to the frame or the like, which is made of non-porous material, by bonding, fitting or welding after the forming. Therefore, it takes a long time to assemble these devices, and the manufacturing cost becomes considerably high. Furthermore, when manufacturing is finished, the problems associated with the lack of strength remains. Therefore, as described above, many problems are associated with the practical use of the conventional vanes made of porous material.

OBJECT AND SUMMARY OF THE INVENTION

The present invention is aimed to solve the above-mentioned conventional problems. Therefore, it is an object to provide a blower and a method of manufacturing an impeller thereof, whereby it is simple to manufacture at a high rate of productivity. Moreover, in the present invention, there are no strength problems regardless of the fact that the vanes are constituted of porous material in order to reduce noises.

In a blower including a plurality of impeller vanes in accordance with the present invention, each impeller vane comprises:

a porous part having fine through-holes which communicate with both sides and being disposed in relatively central part of the vane and a non-porous part of a solid resin being disposed in relatively peripheral part of the vane, the porous part and non-porous part being formed continuously in one unit.

And, a method for manufacturing impeller vane of the blower in accordance with the present invention comprises:

a step of forming a porous part of a predetermined pattern;

a step of inserting the porous part into a separable die assembly having a porous part clamping die for clamping the porous part therein and a non-porous part molding die which is provided adjacent to the porous part clamping die as a body separate therefrom for forming a non-porous part of the solid resin; and a step of allowing the porous part clamping die to clamp the porous part at pressure higher than the forming pressure of the non-porous part with a solid resin.

According to the above-mentioned configuration, a porous member is used in a portion, for example, a non-peripheral portion, of the vanes and a non-porous member consisting of a solid resin preferably of the same or analogous material is used in another portion, for example, peripheral edges of the vanes, and both portions are formed in an integral unit. Thereby, when air flow passes through the porous member surface it goes in and out thereof. More specifically, the air passes in and out of the vane's porous surface from a higher pressure side thereof and a lower pressure side thereof. That is, both sides of the vanes are in air communication. Therefore, excessive pressure variations produced on the vane surface are prevented, and hence noises due to such pressure variations are reduced. Furthermore, the lack of strength of the porous member is compensated for by the peripheral portion, or the like, which is of a material other than the porous member of the vanes, for example, a solid resin at the peripheral edges of the vanes, thereby solving the problem of strength.

Moreover, by selecting the base materials of the porous member and the non-porous member of a same quality or type, the porous member and the non-porous member constituting the vanes are harmonized and bonded together tightly. This is advantageous from the standpoint of strength.

Meanwhile, by arranging separate dies for the porous member and the non-porous member in an adjacent fashion to form the porous member and the non-porous member in an integral unit, each of the constituent parts is easy to manufacture, and the cost of dies is reduced as compared with a larger die. Also, the impeller of the present invention is easy to manufacture, and an impeller for blower having low noises can be obtained in a short time at low cost. Moreover, by applying, to at least the peripheral portion of the porous member portion, a die-pressure higher than or equal to the forming pressure (namely, the pressure of the injection molding) of the solid resin to form the two members integrally, the molten non-porous solid resin is largely prevented from penetrating into the porous material side during the formation.

Furthermore, in case a movable die which presses the porous member of the vanes is formed delimited to the area at the vicinity around the peripheral parts of the porous member, respective constituents of the vanes are easy to manufacture, and it is possible to reduce the die cost and to improve the workability thereof.

Figure 1:
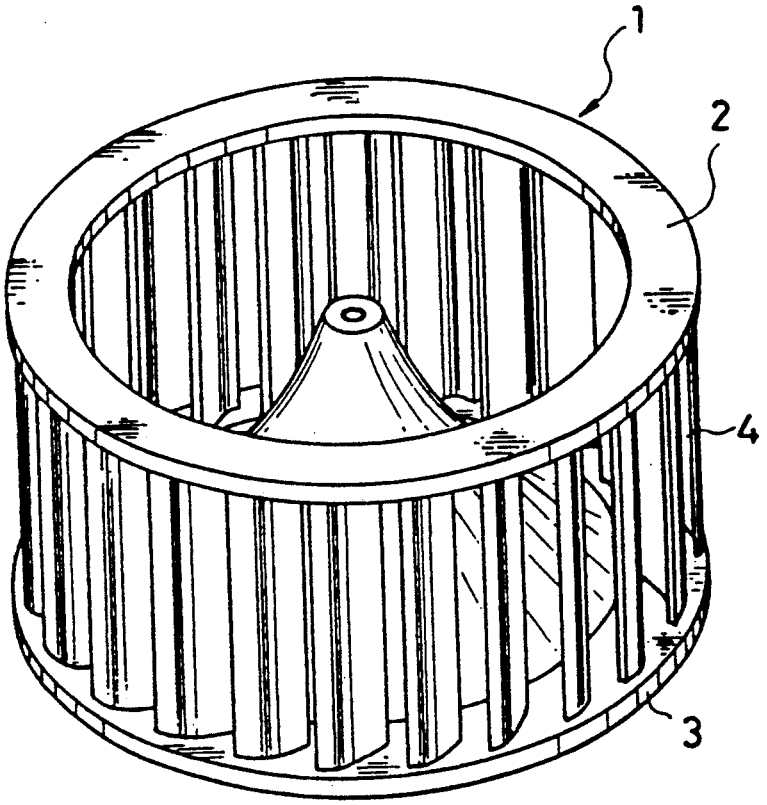
FIG.1 PRIOR ART
FIG. 1 is a perspective view of a conventional impeller of a blower.
Figure 2:
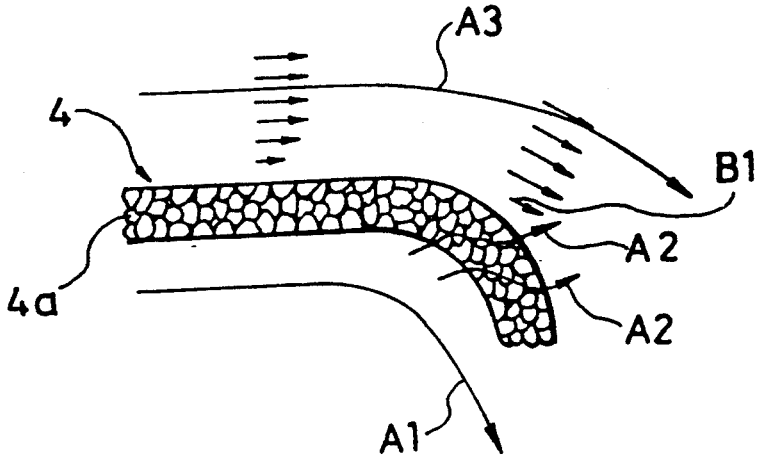
PRIOR ART FIG.2
FIG. 2 is a sectional view of a vane of the impeller.

It will be recognized that some or all of the Figures are schematic representations for purposes of illustration and do not necessarily depict the actual relative sizes or locations of the elements shown.

DESCRIPTION OF THE PREFERRED EMBODIMENT

In the following, a blower in one embodiment of the present invention is described referring to the drawings.

Figure 3:
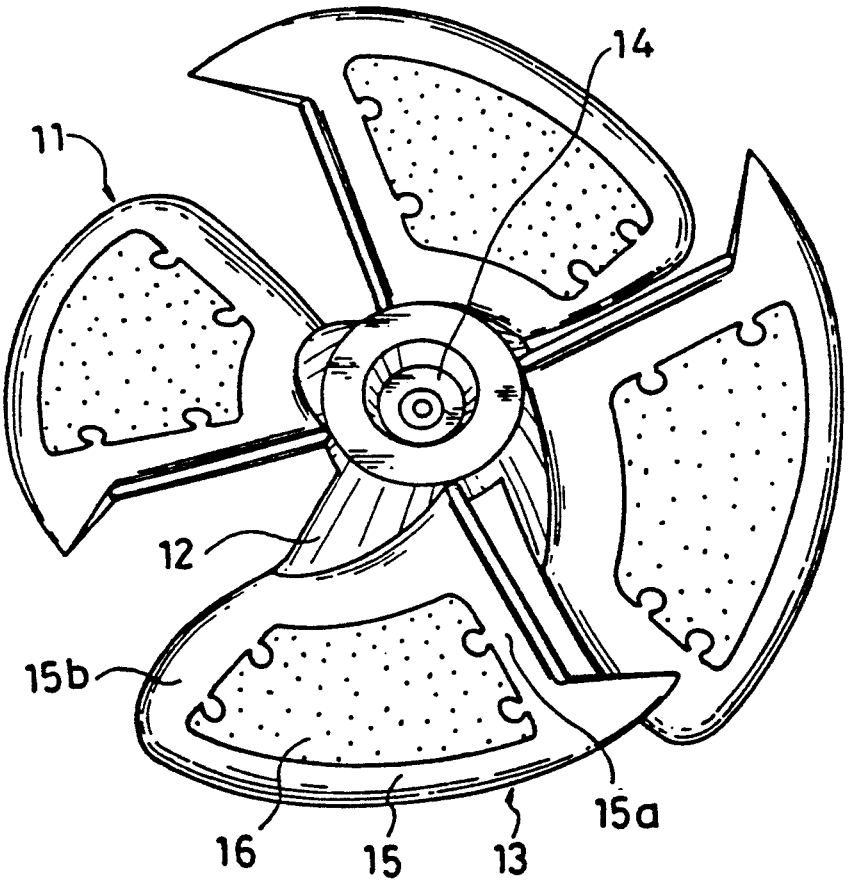
FIG. 3 is a perspective view of an impeller of a blower in one embodiment of the present invention.
Figure 4:
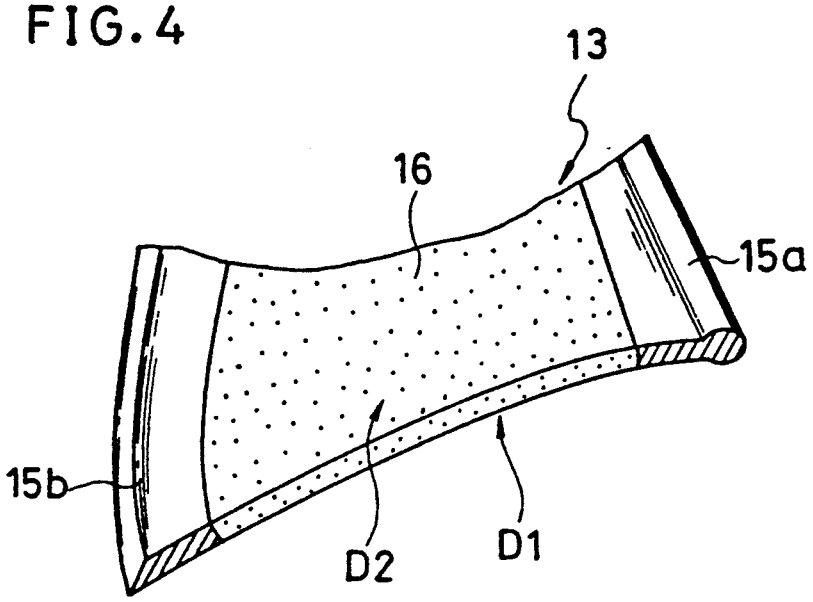
FIG. 4 is a sectional view of a vane of the impeller.

FIG. 3 is a perspective view of an impeller for a blower in one embodiment of the present invention, and FIG. 4 is a fragmental perspective view of a vane of the impeller of FIG. 3. As shown in FIG. 3 and FIG. 4, the impeller 11 is constituted integrally by a truncated conical hub 12, vanes 13 which are provided on peripheral edges of the hub 12 and an impeller boss 14. As shown in FIG. 4, the vanes 13 have the essential or the central part thereof made of a porous member 16 consisting of PP (polypropylene), AES (acrylonitrile specific ethylenepropylene rubber styrene) or the like substance of porous constitution. This central portion has a large number of communicating pores which penetrate through the higher pressure face side D1 and the lower pressure face side D2. The remaining portions, including hub 12 and the peripheral edges 15, including front vane edge 15*a* and a rear vane edge 15*b*, are made of a non-porous synthetic resin such as polypropylene and the like. The center area of the porous member 16 and the peripheral edges 15 of the non-porous member are formed into one unit.

Figure 5:
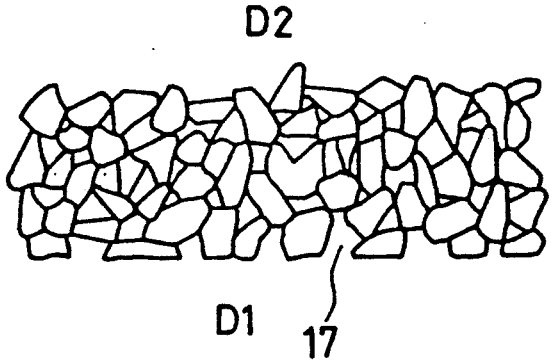
FIG. 5 is a schematic structural view of a sintered resin material in a porous member of the vane.

The material of the porous member 16 (hereinafter referred to as the sintered resin material) is formed by partially fusing and welding synthetic resin powder. The resin powder is piled and heated to form the communicating pores. A schematic view of its fine structure is shown in FIG. 5, wherein through a large number of communicating pores 17, both sides of the porous member, for example, between the pressure face side D1 and the negative pressure face side D2 are in communication. The materials of the porous member 16 and the peripheral edge 15 of non-porous synthetic resin member are selected to be the same synthetic resin or analogous synthetic resins so that both members are bonded well into one body.

Figure 6:
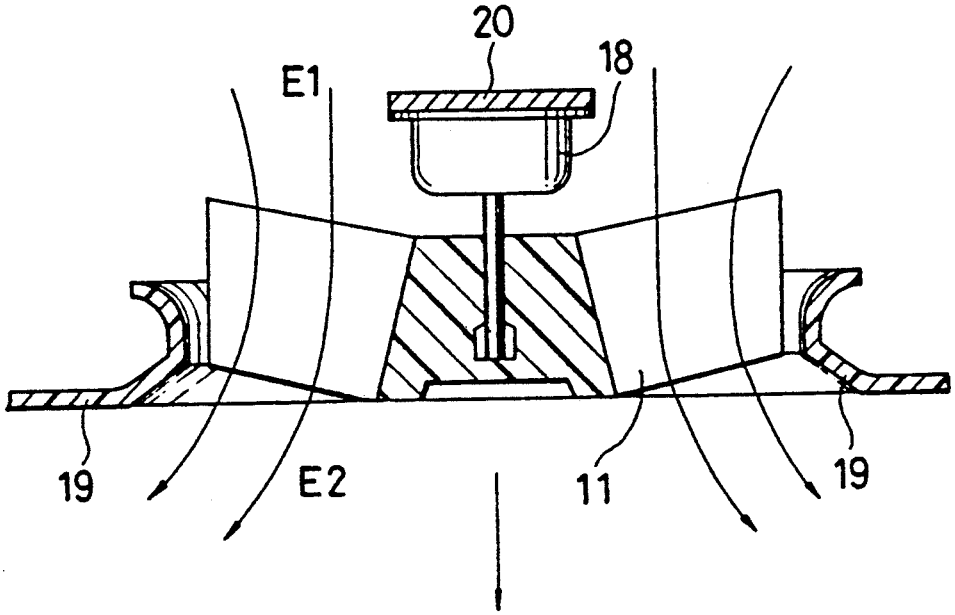
FIG. 6 is a sectional view of a blower using the impeller.

FIG. 6 is a sectional view of a blower using the impeller 11 of FIG. 3. In FIG. 6, the impeller 11 is supported so as to be driven by a motor 18, and disposed at a predetermined position relative to an air guide 19. The motor 18 is mounted on and fixed to a motor support 20. When the impeller 11 is driven in a predetermined rotating direction by the motor 18, air is sucked from the side E1 and is blown out in a direction to the side E2, so as to be operated as a blower.

Figure 7:
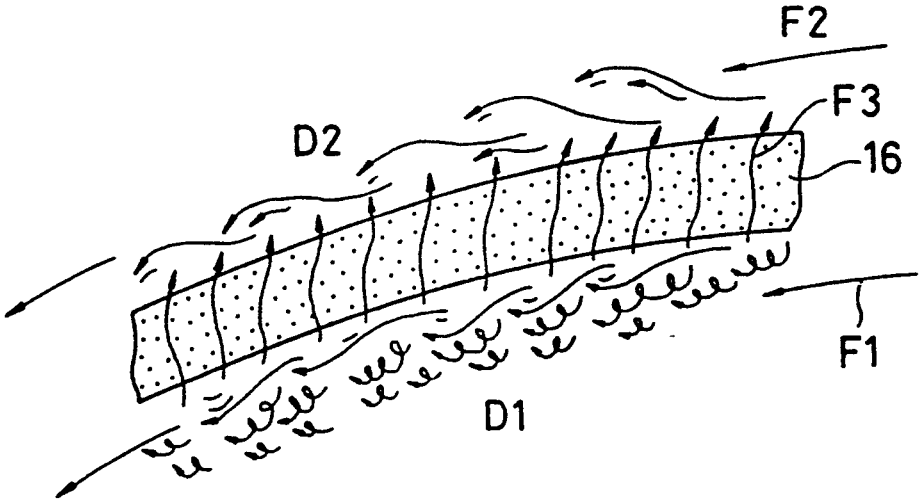
FIG. 7 is a schematic view for explaining a buffer principle of pressure variations in a vane of the impeller.

By using a porous member in the essential part of the vanes, it is possible to reduce noise. That is, when the impeller 11 is rotated, air flows along the impeller surface from the front vane edges 15*a* towards rear vane edges 15*b* of the impeller 11. And as shown in FIG. 7, the air flows along the higher pressure face side D1 and the lower pressure face side D2 of the vanes, to form air flows F1 and F2. Thereafter, the air flows away from the rear vane edges 15*b* and is blown out in a predetermined direction. At this time, on the vane surface, pressure variations of the boundary face of the air flow, or the pressure variations which are produced when shifting to a turbulent flow from a laminar flow take place. Furthermore, pressure variations due to flow separation from the vanes are made depending on the operating condition of the vanes. However, since a partial area excluding the peripheral edges of the vanes is constituted by the porous member 16, undesirable pressure variations produced on the vane surface when the air flow passes through the surface of the porous member 16 are relaxed by the principle as stated hereinbelow. That is, as shown in FIG. 7, since the vane pressure face side D1 (which has the higher pressure) and the vane negative pressure face side D2 (which has the lower pressure) are in communication via fine holes of the communicating pores 17, the air flows therethrough as indicated by air flow F3 when pressure on the vane pressure face side D1 becomes high, and the pressure variations are thereby reduced. Conversely, when pressure on some part of the vane negative pressure face side D2 becomes high, the air flows into the communication pores in a direction opposite that of F3, and the air flows out to the vane pressure face side D1. Thus the pressure variations are similarly reduced. As a result, noises due to the pressure variations which are produced on the vane surface are also reduced.

Figure 8:
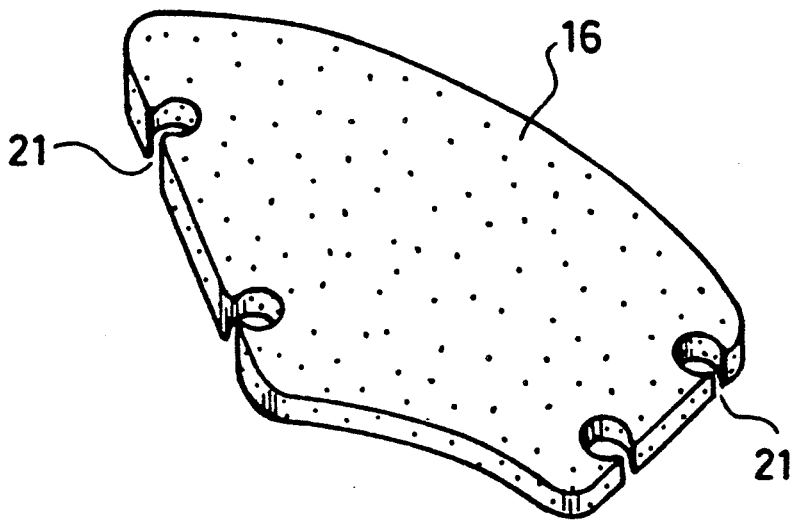
FIG. 8 is a perspective view of a porous member of the vane.

As shown in FIG. 8, the porous member 16 consisting of the sintered resin material includes a plurality of substantially semicircular notches 21, which are to be filled with the non-porous synthetic resin used to form the peripheral edge 15 and the hub 12.

Figure 9:
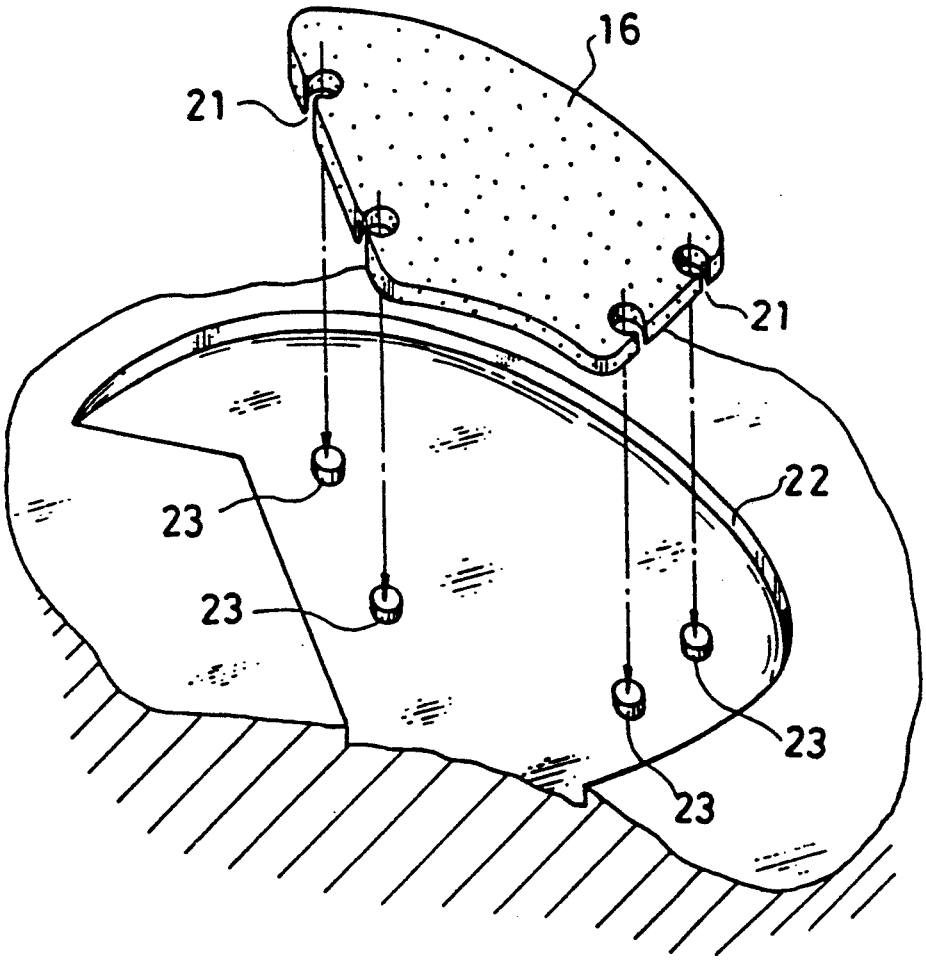
FIG. 9 is a fragmentary perspective view of a die showing a method of manufacturing the impeller.

A method of manufacturing such impeller 11 (FIG. 3) is described as follows. First, the porous member 16 consisting of the sintered resin material and having the notches 21 shown in FIG. 8 is prepared. In this case, it may be formed by a die having the same shape when sintering the sintered resin material, or alternatively may be modeled from a regular sintered material by a blanking method or the like. Next, the porous member 16 of the sintered resin material thus obtained is mounted on a recess of a die 22 for injection molding as shown in FIG. 9. At this time, pins 23 for temporarily fixing the porous member 16 are projected in the recess of the die 22. The notches 21 provided in the porous member 16 are fit to the temporary fixing pins 23 to fix the porous member 16 temporarily.

Figure 10A:
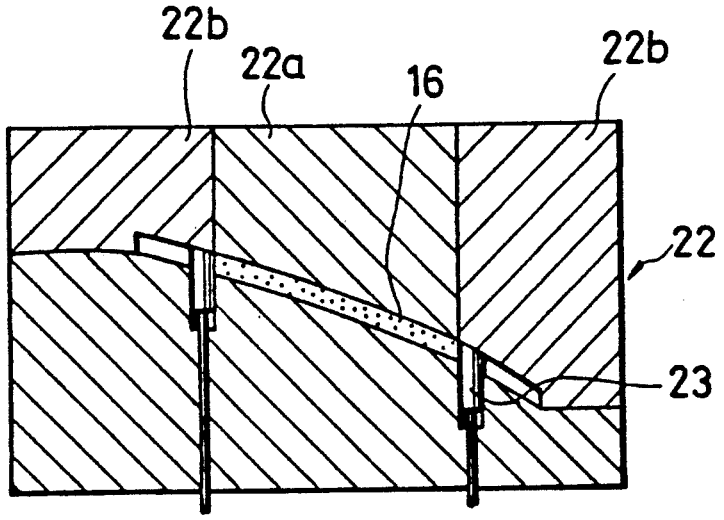
FIGS. 10A, 10B, and 10C are sectional views showing the progressive steps of forming a vane of the impeller.
Figure 10B:
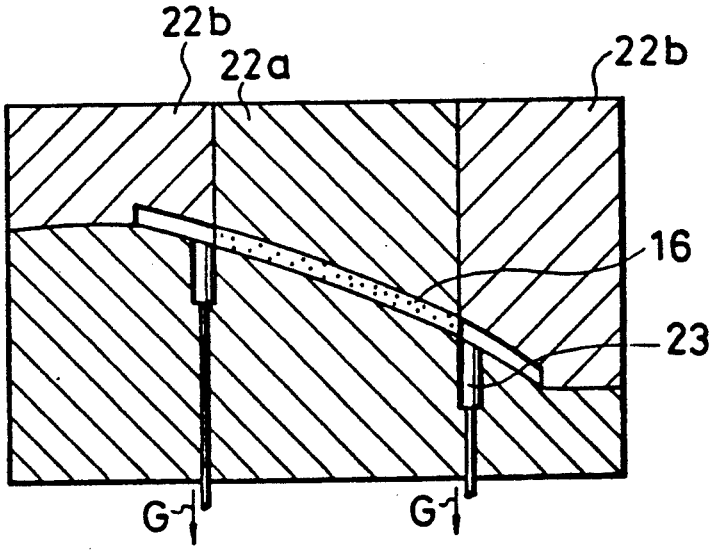
Figure 10C:
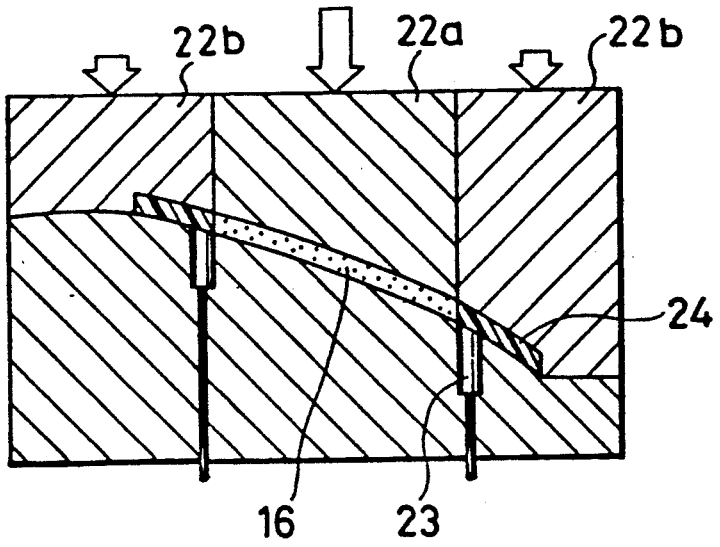

The die 22 is then closed. As shown in FIG. 10 (A), a movable die 22*a* which clamps and forms the portion of porous member 16, and a molding die 22*b* which forms the solid resin of the non-porous member are divided. These movable dies 22*a* and 22*b* are fixed completely along the die surface. Meanwhile, as shown in FIG. 10B, the temporary fixing pins 23 are moved down in a direction of the arrow G and drawn out from the molding die 22*b*. Subsequently, as shown in FIG. 10(C), a solid or non-porous resin 24 is injected into the molding die 22*b* to form the peripheral edges 15 of the vanes 13. And at the same time, the solid resin 24 is filled in the notches 21 of the porous member 16 to form the peripheral edges 15 and the porous member 16 constituting the vanes 13 in an integral unit.

By dividing the die and restricting a movable portion of the die to correspond only to the peripheral portion of porous member 16, respective constituents of the vanes are easy to manufacture. Thus the cost of the die is reduced and the workability in forming an integral unit is improved. By giving a die-pressure at least in the peripheral portion of the porous member 16 equal to or higher than that in the solid resin portion 24 during the formation, the molten material of the solid resin 24 is prevented from undesirably diffusing largely into the porous member 16. Moreover, it is desirable that the quality or type of raw materials used for the porous material and the solid material is similar so that the porous member 16 and the solid resin 24 constituting the vanes are well harmonized and bonded together tightly, which is advantageous from the standpoint of strength.

Though the die of the vanes is shown in FIG. 10, the hub 12 is also formed simultaneously with the edge portions of the porous member 16.

In this embodiment, though the impeller has been described by an axial flow fan, it is possible to obtain the same effect by application to other fan types such as a multiblade fan.

Although the present invention has been described in terms of the presently preferred embodiments, it is to be understood that such disclosure is not to be interpreted as limiting. Various alterations and modifications will no doubt become apparent to those skilled in the art after having read the above disclosure. Accordingly, it is intended that the appended claims be interpreted as covering all alterations and modifications as fall within the true spirit and scope of the invention.

What is claimed is:

1. A blower including a plurality of rotatable impeller vanes operable to impel air, said impeller vanes creating an air pressure differential thereacross when rotated, each of said impeller vanes comprising:

a porous central portion made of sintered resin material, said porous central portion having a plurality of pores therein which permit a portion of air to pass through said porous central portion from a relatively high air pressure side to a relatively low air pressure side of said impeller vanes; and a non-porous portion surrounding said porous central portion, said non-porous portion being made of a solid resin material which prevents said air from passing therethrough.

2. The blower as claimed in claim 1 wherein said sintered resin material and said solid resin material are composed of a same substance.

3. The blower as claimed in claim 2 wherein said substance is polypropylene.

4. The blower as claimed in claim 2 wherein said substance is acrylonitrile specific ethylene-propylene rubber styrene.

5. The blower as claimed in claim 1 wherein said sintered resin material is formed from partially fused resin powder.

6. The blower as claimed in claim 1 further comprising motor means for rotating said impeller vanes.

7. The blower as claimed in claim 1 wherein said porous central portion and said non-porous portion are integrally formed.

8. An impeller vane being rotatable to impel air, said impeller vane creating an air pressure differential thereacross when rotated, said impeller vane comprising:

a porous central portion made of sintered resin material, said porous central portion having a plurality of pores therein which permit a portion of air to pass through said porous central portion from a relatively high air pressure side to a relatively low air pressure side of said impeller vane; and a non-porous portion surrounding said porous central portion, said non-porous portion being made of a solid resin material which prevents said air from passing therethrough.

9. The impeller vane as claimed in claim 8 wherein said sintered resin material and said solid resin material are composed of a same substance.

10. The impeller vane as claimed in claim 9 wherein said substance is polypropylene.

11. The impeller vane as claimed in claim 9 wherein said substance is acrylonitrile specific ethylene-propylene rubber styrene.

12. The impeller vane as claimed in claim 8 wherein said sintered resin material is formed from partially fused resin powder.

* * * * *